US009815101B2

(12) United States Patent
Krimpelstätter

(10) Patent No.: US 9,815,101 B2
(45) Date of Patent: Nov. 14, 2017

(54) REVERSING ROLLING MILL AND OPERATING METHOD FOR A REVERSING ROLLING MILL

(75) Inventor: Konrad Krimpelstätter, Katsdorf (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 203 days.

(21) Appl. No.: 14/237,132

(22) PCT Filed: Jul. 26, 2012

(86) PCT No.: PCT/EP2012/064651

§ 371 (c)(1),
(2), (4) Date: Feb. 4, 2014

(87) PCT Pub. No.: WO2013/029886

PCT Pub. Date: Mar. 7, 2013

(65) Prior Publication Data

US 2014/0238093 A1 Aug. 28, 2014

(30) Foreign Application Priority Data

Aug. 30, 2011 (EP) ..... 11179241

(51) Int. Cl.
*B21B 45/02* (2006.01)
*B21B 1/36* (2006.01)
*B21B 15/00* (2006.01)

(52) U.S. Cl.
CPC ..... *B21B 45/0251* (2013.01); *B21B 1/36* (2013.01); *B21B 15/005* (2013.01); (Continued)

(58) Field of Classification Search
CPC ..... B21B 37/44; B21B 15/005; B21B 1/36; B21B 45/0251; B21B 2261/14; B21B 2263/04; B21B 2015/0057
See application file for complete search history.

(56) References Cited

U.S. PATENT DOCUMENTS 6,128,937 A 10/2000 Seidel ..... 72/161
6,286,354 B1 * 9/2001 Kajiwara ..... B21B 13/023 72/237

(Continued)

FOREIGN PATENT DOCUMENTS

CN 1212912 A 4/1999
CN 101605617 A 12/2009

(Continued)

OTHER PUBLICATIONS

JP62009707A is attached.*

(Continued)

*Primary Examiner* — Peter DungBa Vo
*Assistant Examiner* — John S Lowe
(74) *Attorney, Agent, or Firm* — Ostrolenk Faber LLP

(57) ABSTRACT

Operating method for a reversing rolling mill having at least one reversing rolling stand (2) for rolling a rolled metal stock (5), wherein the stock (5) passes the at least one reversing rolling stand (2) in a sequence of alternating direction passes (7) and after each pass, the stock is wound up by a reversing reel (3, 4), wherein only rolling oil, without water as a carrier medium, is applied to the stock (5) by rolling-oil applicator (6), between the at least one reversing rolling stand (2) and the winding-up reel (31, 41).

14 Claims, 2 Drawing Sheets

(52) U.S. Cl.
CPC ... *B21B 45/0218* (2013.01); *B21B 2015/0057* (2013.01); *B21B 2015/0064* (2013.01)

(56) References Cited

U.S. PATENT DOCUMENTS

| | | | | |
|---|---|---|---|---|
| 2008/0087066 | A1* | 4/2008 | Takahama | B21B 1/28 72/45 |
| 2010/0101291 | A1* | 4/2010 | Richter | B21B 37/44 72/9.1 |
| 2013/0186156 | A1 | 7/2013 | Richter | |

FOREIGN PATENT DOCUMENTS

| | | | | | |
|---|---|---|---|---|---|
| DE | 10 2007 032485 | A1 | | 6/2008 | |
| EP | 0 906 797 | A1 | | 4/1999 | |
| JP | 57-156809 | A | | 9/1982 | |
| JP | 61-052901 | A | | 3/1986 | |
| JP | 62-9707 | | | 1/1987 | |
| JP | 62009707 | A | * | 1/1987 | B21B 45/0251 |
| JP | 2-274302 | A | | 11/1990 | |
| JP | H11-156405 | A | | 6/1999 | |
| JP | 3815075 | B2 | | 8/2006 | |
| WO | WO 2005/115651 | A1 | | 12/2005 | |

OTHER PUBLICATIONS

Chinese Office Action, dated Jan. 19, 2015, issued in corresponding Chinese Patent Application No. 201280042645.0, filed Jul. 26, 2012. English translation. Total 23 Pages.

International Search Report dated Oct. 2, 2012 issued in corresponding International patent application No. PCT/EP2012/064651.

International Preliminary Report on Patentability issued in corresponding International patent application No. PCT/EP2012/064651.

European Patent Office Communication dated Nov. 16, 2016 enclosing a Notice of Opposition filed in corresponding European Application No. EP12742868.8 (European Patent No. EP2750813) (17 total pages).

* cited by examiner

REVERSING ROLLING MILL AND OPERATING METHOD FOR A REVERSING ROLLING MILL

CROSS-REFERENCE TO RELATED APPLICATIONS

The present application is a 35 U.S.C. §§371 national phase conversion of PCT/EP2012/064651, filed Jul. 26, 2012, which claims priority of European Patent Application No. 11179241.2, filed Aug. 30, 2011, the contents of which are incorporated by reference herein. The PCT International Application was published in the German language.

TECHNICAL FIELD

The invention relates to a reversing mill and an operating method for a reversing mill, the mill comprising at least one reversing stand for rolling a metal stock, wherein the stock passes through the at least one reversing stand in a sequence of passes in alternating directions and is wound up after each pass by means of a reversing reel acting as a coiler.

BACKGROUND ART

In a reversing stand, the stock is reduced in thickness in a back and forth motion in a sequence of passes. In the case of known cold-rolling mills, an oil/water emulsion having an oil concentration of around 0.5 to 5% is normally used for roll gap lubrication, roll cooling and roll cleaning. If the oil concentration is increased, the lubricating effect generally increases, i.e. there is less roll gap friction, whereas the cooling effect is reduced.

In the case of tandem mills, approximately ⅓ the quantity of emulsion per stand is applied to the work rolls or to the metal strip on the entry side immediately upstream of the roll gap for roll gap lubrication. The remaining ⅔ are used on the exit side primarily for cooling the work rolls but also for roll cleaning, particularly for cleaning the back-up rolls.

In the case of a reversing stand, all the emulsion for each roll is generally applied on the entry side to the work rolls or to the strip immediately upstream of the roll gap.

Depending on the installed power of the main drives, the flow rate for a cold-rolling mill is e.g. 0.8 l per minute and kilowatt hour of input power. For a input power of 6000 kW per stand, for example, this means a coolant/lubricant (emulsion) flow rate of 4800 l per minute.

Despite this large quantity of lubricant, the required amount of lubricant in the roll gap may be inadequately adjusted. In particular, the problem arises that the amount of oil available in the roll gap for roll gap lubrication is primarily predetermined by the cooling requirements and not by the current lubrication requirements in the roll gap. It must be assumed that, in the case of emulsion lubrication in the roll gap, the oil concentration will be well below 100%, resulting in a reduced lubricating action. In practice, this means that the rolling oil consumption is much higher than the amount of lubricant actually required for lubricating the roll gap. Selectively controlling the current lubrication and friction conditions is only possible to a limited extent in this manner, e.g. only via the oil concentration in the emulsion or via additives.

In WO 2005/115651 A1 it is therefore proposed to inject a base oil without water as a carrier medium into the roll gap. As the lubricant is applied to the stock before it enters the roll gap, an appropriate quantity of lubricant for an even application is necessary.

SUMMARY OF THE INVENTION

The object of the invention is to specify a reversing mill and an operating method for a reversing mill, wherein the rolling oil consumption can be further reduced while maintaining good roll gap lubrication.

This object is achieved by a reversing mill having the features of the invention and by an operating method for a reversing mill having the features of the invention.

According to a basic feature of the invention, instead of the lubricant being supplied to the roll gap on the entry side, the stock is lubricated in a preceding operation during coiling. As a result, the lubricant is compressed and homogenized by the successive layers so that the quantity of lubricant can be further reduced. The even surface application of the lubricant ensures that, despite the small quantity of lubricant, the roll gap can be sufficiently lubricated. Viewed in the axial direction of the work rolls, the same friction conditions obtain. The stock therefore undergoes uniform deformation and heating. This has an advantageous effect on the surface quality of the rolled stock, as it has fewer chatter marks. As the flow of coolant is decoupled from the supply of lubricant, the lubrication can be better matched to the parameters of the rolling process. There is the added advantage that the coolant, e.g. water, can be supplied at a low temperature compared to emulsion lubrication, so that the heat removal is better.

This makes conventional roll lubrication on mill stand entry obsolete. According to the invention, the lubricating action is achieved via the pre-lubricated incoming metal strip. In general, the precursor material for a reversing stand comes from a pickling plant (continuous or push-pull picking line) in which the metal strips are lubricated after pickling for the purpose of corrosion protection. These lubricated strips enter the reversing stand as the input material for the first pass. After the first pass the metal strip is wound on a reversing reel acting as a coiler and—if another pass is to follow—is lubricated prior to winding.

In order to a achieve a maximally uniform lubricating action while minimizing lubricant consumption, it may be advantageous if the rolling oil is applied evenly over the entire width of the stock in the form of an atomized oil mixture. During winding, the individual layers of the metal strip come into contact and have a homogenizing effect on the rolling oil applied. The rolling oil thoroughly penetrates the peak-to-valley roughnesses of the stock and produces a good lubricating action for the subsequent rolling process.

In a preferred embodiment it is provided that the rolling oil is applied in a comparatively small quantity of less than 200 ml per minute, preferably in a range of approximately 50 to 100 ml per minute.

As the stock is rolled in any case with low reductions in the final pass, it may be advantageous if no rolling oil is applied to the stock prior to the final and/or prior to the penultimate pass. This enables the consumption of lubricant to be reduced still further, as the lubrication requirements are less in the final pass. For the final pass, the oil remaining on the metal strip from previous passes is usually enough to still provide a sufficient lubricating effect for a small thickness reduction.

BRIEF DESCRIPTION OF THE DRAWINGS

For further explanation of the invention, reference will be made in the following section of the description to the accompanying drawings from which additional advantageous embodiments, details and further developments of the invention will emerge on the basis of a non-limiting example.

IMPLEMENTATION OF THE INVENTION

Figure 1:
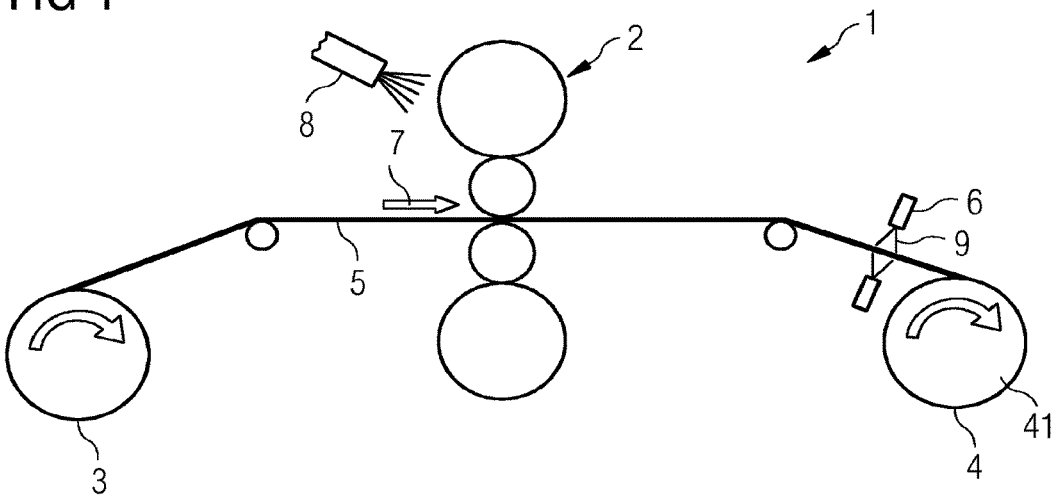
FIG. 1 schematically illustrates a reversing mill consisting of a mill stand and two reversing reels, in the first pass state.

FIG. 1 shows a simplified schematic view of a reversing mill 1. In a reversing mill 1 of this kind, the stock 5 passes through one or more mill stands in an alternating direction of travel 7. In this schematic example, the reversing mill 1 comprises a single reversing stand 2. Disposed on either side of said reversing stand 2 is a reversing reel 3, 4. Depending on the direction of travel 7 of the stock 5, these reversing reels 3, 4 are used either as coilers or uncoilers. FIG. 1 shows the first pass in which the reversing reel 3 constitutes an uncoiler and the reversing reel 4 constitutes a coiler 41. An already lubricated strip 5, coming from a pickling line, for example, is reduced in thickness in the roll gap of the reversing stand 2. Said strip 5 passes through the work rolls of said reversing stand 2 from left to right in the travel direction 7 indicated. As FIG. 1 shows, according to the invention no lubricant is supplied to the roll gap on the entry side of the mill stand 2, either to the work rolls or onto the surface of the rolled strip 5. The lubricating action is provided solely by the rolling oil carried in from the pickling line and adhering to the rolled strip 5.

The rolls of the mill stand 2 are cooled using a coolant completely separate from the lubricant. In this example the coolant is pure water which is sprayed onto the rolls of the reversing stand 2 by means of a device 8, e.g. a row of nozzles. When the strip 5 has passed through the roll gap, it is wound onto a reversing reel 4 on the right-hand side of FIG. 1. Said reversing reel 4 here acts as a coiler 41. As already stated, in contrast to the prior art, no emulsion for lubrication or cooling purposes is applied either to the rolled strip or to the rolls of the mill stand as the strip enters the stand. The lubrication action is only provided via the incoming, lubricated stock. Only water, without added lubricant, is used for cooling.

Lubrication of the stock takes place in an operation preceding the rolling pass, with rolling oil being applied to the metal strip prior to winding. This is performed by a rolling oil applicator 6 which sprays the rolling oil 9 onto both the upper side and underside of the strip 5. As a result, the rolling oil adheres very well to the rough surface of the stock. The rolling oil can be a base oil that is provided with additives.

Particularly for a cold-rolling process it is important that the film of lubricant is all applied as uniformly as possible over the entire width of the path. A rolling oil applicator suitable for this purpose can be of different designs, e.g. an arrangement of a plurality of nozzles in the form of a spray, nozzle or injector bar. In the following, such devices are assumed to be known and are not the subject matter of the present invention.

Figure 2:
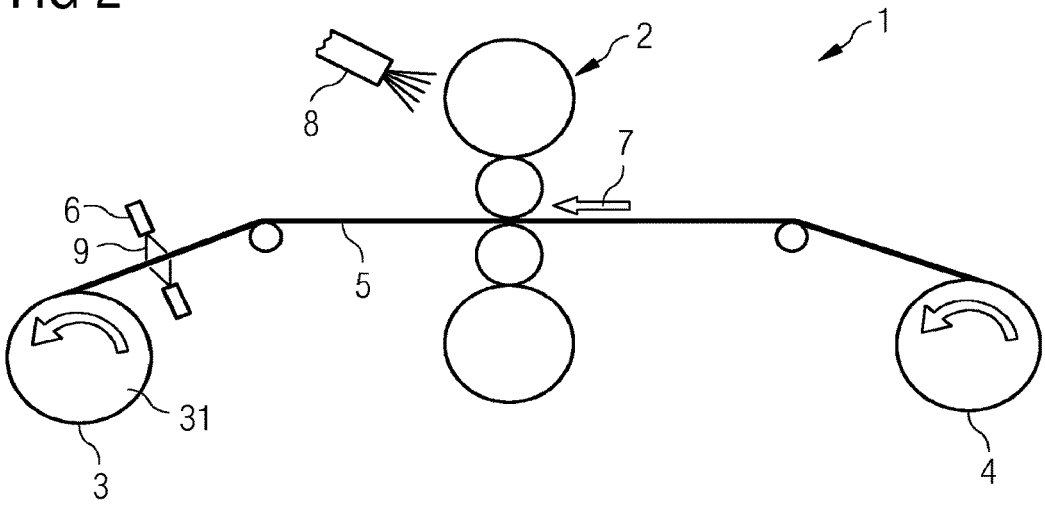
FIG. 2 shows the reversing mill according to FIG. 1, in the second pass state.

FIG. 2 now shows the second pass following on from pass one. The direction of travel 7 has now reversed, i.e. it runs from right to left. The two reversing reels 3, 4 now rotate in the opposite direction, i.e. counter-clockwise. Reversing reel 3 now acts as a coiler 31. Before the strip 5 is wound on the coiler 31, the strip is re-lubricated by means of an oil applicator 6 disposed on the exit side (corresponding to the changed direction of travel, now to the left in FIG. 2). Once again, rolling oil 9 is applied to both sides of the strip 5. The rolling oil 9 in not mixed with a liquid carrier medium such as water, for example. The rolls of the reversing stand 2 are again cooled with fresh water and the cooling is separate from the lubrication in the roll gap.

As is clear from the above, in the example described a rolling oil applicator 6 of this kind is disposed upstream of each reversing reel 3, 4, as each of the reversing reels 3, 4 operates alternately as a coiler or uncoiler depending on the respective direction of travel 7 of the metal strip 5; for the sake of simplicity, only the rolling oil applicator 6 that is active, i.e. in operation, in the operating state shown is depicted in FIGS. 1 and 2.

Thickness reduction in the subsequent rolling passes takes place in the normal manner for reversing stands whereby the stock is successively reduced in thickness in a back and forth motion in the roll gap between the work rolls. These passes of the cold rolling process are not shown in the drawings.

Figure 3:
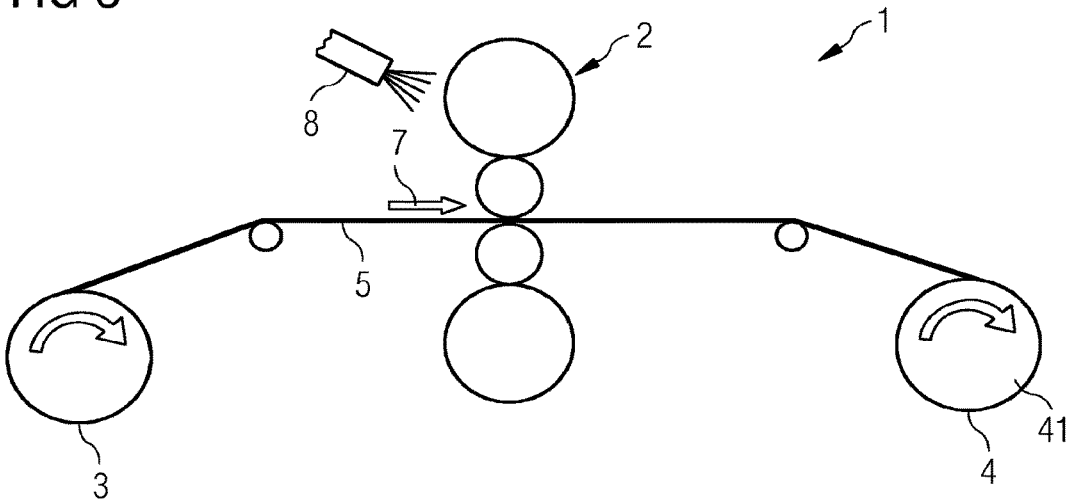
FIG. 3 shows the reversing mill according to FIG. 1, in the final pass state.

The final pass is depicted in FIG. 3. As can be seen from FIG. 3, in the final pass no lubricant is applied to the metal strip, the lubricating effect being achieved by residual rolling oil already applied in the preceding or last-but-one pass to the surface of the strip and remaining thereon. This residual quantity of lubricant is sufficient, as the reduction of the rolled stock 5 is usually very small in the final rolling pass.

An essential advantage of the invention is that the amount of oil required for a cold rolling stand can be significantly reduced. As the lubricating and cooling media are separated, the quantity of lubricant can be adjusted as a function of process variables such as strip speed, rolling force, roll roughness, etc. This possibility of differentiated lubrication adjustment is greatly advantageous.

As the oil concentration is 100% in the roll gap, rolling forces and rolling torques can be reduced, thereby providing an overall energy saving.

As lubrication is separated from cooling, a comparatively low temperature coolant can be used, which improves the cooling effect. As a result, further savings can be made in terms of the amount of water required for cooling. By way of comparison, when using emulsion the emulsion temperature must not be below about 48° C., as otherwise fungal and bacterial growth would be promoted.

Advantageously, a metastable or even unstable rolling oil having a low emulsifier content is used. The metastable or unstable rolling oil can be very easily separated from the water and only water needs to be conditioned in the circulating line. It is possible to re-use the oil that has been separated from the water.

Altogether, both the rolling oil consumption and the quantity of coolant can therefore be reduced. The equipment complexity for conditioning the media for lubrication and cooling is comparatively lower, resulting in lower capital investment and operating costs.

Although the invention has been illustrated and described in detail by the above exemplary embodiment, the invention is not limited by the example disclosed and other variations can be deduced therefrom by the average person skilled in the art without departing from the scope of protection of the invention.

LIST OF REFERENCE CHARACTERS USED

1 reversing mill
2 reversing stand
3 reversing reel

4 reversing reel
5 rolled stock
6 rolling oil applicator
7 direction of travel
8 coolant applicator
9 rolling oil
31 reversing reel 3 as coiler
41 reversing reel 4 as coiler

The invention claimed is:

1. An operating method for a reversing mill for reverse milling a stock, wherein the mill comprises at least one reversing stand with rolls for rolling a metal stock, the method comprises:

providing a lubricated stock before starting an initial pass in a sequence of passes through the reversing mill, the lubricated stock being a lubricated rolled strip;

passing the lubricated stock through the at least one reversing stand in a sequence of passes in alternating reversed directions of travel;

winding up the stock after each pass onto a reversing reel acting as a coiler of the stock;

lubricating the stock with a lubricant prior to winding the stock on the coiler by applying rolling oil as a carrier medium to the stock, and without applying water, between the at least one reversing stand and the coiler for causing a lubricating effect solely by the rolling oil applied to the stock prior to the coiling of the stock; and cooling the reversing stand with a flow of coolant completely decoupled from the supply of lubricant by directly applying coolant that is completely separate in composition, flow rate, temperature, and site of application from the lubricant to at least one of the rolls of the reversing stand.

2. The operating method as claimed in claim 1, further comprising applying the rolling oil evenly over the entire width of the stock and in the form of an atomized oil/air mixture.

3. The operating method as claimed in claim 2, further comprising applying the rolling oil in a quantity of not more than 200 ml per minute.

4. The operating method as claimed in claim 3, further comprising applying the rolling oil in a quantity of between 50 and 100 ml per minute.

5. The operating method as claimed in claim 1, wherein there is a final one and a penultimate one of the passes; and the method further comprising applying no rolling oil to the stock prior to the final pass and/or prior to the penultimate pass.

6. The operating method as claimed in claim 1, further comprising applying rolling oil to the stock by means of a rolling oil applicator.

7. The operating method as claimed in claim 1, further comprising two of the reversing reels, each reversing reel acting as a coiler on one pass and as a decoiler on an alternate pass, the two reels being respectively located outward of opposite sides of the reversing stand; and the method further comprising applying rolling oil to the stock between the at least one reversing stand and the reel then acting as the coiler.

8. A reversing mill for carrying out the method of claim 1, the reversing mill comprising:

at least one reversing stand with rolls, through which metal stock passes in a sequence of alternating directions of travel;

reversing reels configured and operable for coiling and uncoiling the stock dependent on the direction of travel of the reels and the stock, the reels being located at opposite sides of the stand disposed at entry and exit sides of the stand;

a rolling oil applicator configured and operable for applying rolling oil to the stock without also applying water as a carrier medium, the applicator is disposed between the at least one reversing stand and the reversing reel then acting as the coiler, so that the stock is lubricated before the stock is wound on the coiler, wherein a lubricating effect is produced solely by the rolling oil applied to the stock prior to coiling; and a device arranged, configured and operable to supply coolant, completely separate in composition, flow rate, temperature, and site of application from the oil, directly to at least one of the rolls of the at least one reversing stand.

9. The reversing mill as claimed in claim 8, wherein the rolling oil applicator is configured to apply the rolling oil evenly over the entire width of the stock and in the form of an atomized oil mixture.

10. The reversing mill as claimed in claim 9, wherein the rolling oil applicator is configured to apply the rolling oil to the stock in a maximum quantity of 200 ml per minute.

11. The reversing mill as claimed in claim 9, wherein the rolling oil applicator is configured to apply the rolling oil to the stock at between 50 and 100 ml per minute.

12. The reversing mill as claimed in claim 8, wherein the rolling oil applicator is configured to apply no rolling oil to the stock prior to a final pass and/or prior to a penultimate pass of the stock through the stand.

13. The operating method as claimed in claim 1, wherein no lubricant is supplied to a roll gap in the reversing stand other than lubricant on the rolled strip.

14. The operating method as claimed in claim 1, wherein the coolant comprises water that does not include lubricant.

* * * * *